US006705195B1

(12) United States Patent
Thornton

(10) Patent No.: US 6,705,195 B1
(45) Date of Patent: Mar. 16, 2004

(54) METHOD AND APPARATUS FOR GUN BARREL COOLING

(76) Inventor: Brian Thornton, 1330 N. Park Dr., Richardson, TX (US) 75081

( * ) Notice: Subject to any disclaimer, the term of this patent is extended or adjusted under 35 U.S.C. 154(b) by 0 days.

(21) Appl. No.: 10/364,787

(22) Filed: Feb. 11, 2003

(51) Int. Cl.[7] ..... F41A 21/00
(52) U.S. Cl. ..... 89/14.1
(58) Field of Search ..... 89/14.1

(56) References Cited

U.S. PATENT DOCUMENTS

| | | | | |
|---|---|---|---|---|
| 1,216,939 A | | 2/1917 | Brotherston | |
| 4,159,588 A | | 7/1979 | Pfeiffer | |
| 4,463,653 A | * | 8/1984 | Pusch et al. | 89/14.1 |
| 5,117,734 A | | 6/1992 | Rhoads | |
| 5,202,530 A | * | 4/1993 | Stephens | 89/7 |
| 5,726,375 A | | 3/1998 | Adams et al. | |
| 2003/0167909 A1 | * | 9/2003 | Matter | 89/14.1 |

FOREIGN PATENT DOCUMENTS

| | | | | |
|---|---|---|---|---|
| DE | 3430521 A1 | * | 2/1986 | F41F/17/14 |

* cited by examiner

*Primary Examiner*—Michael J. Carone
*Assistant Examiner*—Troy Chambers
(74) *Attorney, Agent, or Firm*—John F. Bryan

(57) ABSTRACT

Apparatus for cooling the barrel of a gun having a receiver configured to receive a magazine, has a housing dimensionally similar to a magazine for insertion into the receiver and contains a fan including a fan motor and shroud with an air inlet and outlet. An electric power source and circuit connector/disconnector operate the fan motor to establish an air flow path through the air inlet and outlet, with the outlet being positioned so that the air flow path passes through the gun barrel.

10 Claims, 2 Drawing Sheets

METHOD AND APPARATUS FOR GUN BARREL COOLING

TECHNICAL FIELD

The present invention relates to the field of firearms and more particularly, to highly precise examples of such apparatus as used in competitive target shooting, wherein every variable factor influencing accuracy must be consistently maintained on successive shots.

BACKGROUND

Competitive target shooting is pursued at many levels, from that of an Olympic event to a recreational pastime. Serious competitors take great pains in their selection and fine tuning of equipment. Ballistic experimentation with different combinations of bullet weights, powder types and charges, together with painstaking preparation and hand loading of cartridges is a given. While the human aspects of maintaining an accurate point-of-aim, including compensation for cross-winds, are basic differentiating factors in scoring, other factors affect the accuracy with which a round strikes at the point-of-aim. It is the reduction of variation in these other factors that is essential to approaching the unattainable, "perfect marksmanship". In the case of a rifle, bedding of the barrel and receiver in the stock may be critical to accuracy. Dynamic characteristics of the barrel, that is, tube vibrations induced by discharge, may also be critical. In short, any physical effect that can vary, ever so slightly, from one round to the next, will affect the point-of-aim accuracy achieved by a given rifle. Skilled marksmen know it is desirable to maintain a uniform barrel temperature for every group of shots, because barrel temperature variations, especially uneven barrel heating or cooling, will degrade accuracy. Thus, at the highest levels of competition, skilled marksmen prefer to sight their rifle in hot, fire several warm-up groups before shooting for score, and hope for cooling periods between firing sequences to hold fairly uniform barrel temperatures. Barrel temperature control may be quite difficult under match conditions, especially while trying to avoid uneven cooling.

Military requirements are more severe. Here accuracy is not the issue so much as barrel life. Rapid fire sequences, without adequate cooling periods, will overheat the barrel so much that the rifling grooves are washed out and the barrel is ruined. In military service, it is a common practice to carry a spare barrel as a back-up, or as an exchange to allow cooling periods.

Therefore, a first object of the present inventions is to provide method and apparatus for enhancing the rate of barrel cooling. A second object of the present inventions is to provide method and apparatus for uniform barrel cooling at this enhanced rate. A third object is to provide method and apparatus that can be implemented under actual field conditions. Another object of the present inventions is to provide readily usable apparatus for extending barrel life under field conditions. Yet another object is to achieve these results at a reasonable cost to the end user, while still allowing a profit incentive for commercial production and distribution.

SUMMARY OF THE INVENTION

The present inventions contemplate improved methods and apparatus for gun barrel cooling. These inventions relate to or employ some steps and apparatus well known in the arts and therefore, not the subject of detailed discussion herein. The present inventions comprise improved methods and apparatus for cooling the barrel of a gun providing that the gun has a receiver configured to receive a magazine.

In a preferred embodiment of the present inventions the shell of a magazine for a given firearm, normally holding a plurality of rounds, is gutted to provide an appropriate housing. As an alternative, a similar part can be formed in sheet metal or plastic. A small, DC fan, of the type commonly used for circulation of cooling air through the interior of electronic devices and of a size suitable for mounting within the transverse inside dimensions of the housing, provides air flow for cooling. The mounting location of the fan is such that its air outlet will be directed into the chamber of the firearm when the housing is installed in the manner of a magazine. A DC power supply, preferably included inside of the housing, in the form of one or more batteries and a circuit connector/disconnector, completes this embodiment of the present inventions. The circuit connector/disconnector may be located where it is automatically operated by insertion of the barrel cooler housing into the receiver, or it may be located where it is accessible for manual operation. A useful accessory, for firearms having a bolt that does not lock in a retracted position on an empty chamber, is a bolt stop plate at the rear of the housing. Another useful accessory is an indicator flag, which extends from the ejector port when the barrel cooler is inserted, making it obvious that the weapon is in a safe condition.

BRIEF DESCRIPTION OF THE DRAWINGS

The accompanying drawings are incorporated into the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
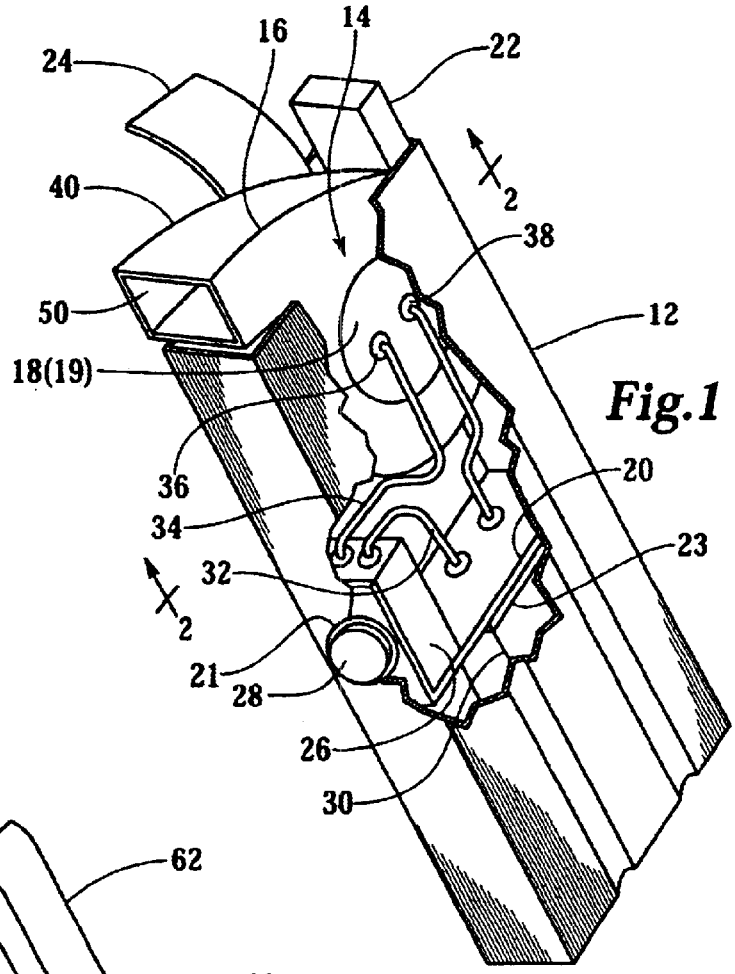
FIG. 1 is a perspective view of a preferred embodiment of the barrel cooling apparatus of the present inventions.

The present inventions are described in the following by referring to drawings of examples of how the inventions can be made and used. In these drawings, reference characters are used throughout the views to indicate like or corresponding parts. The embodiments shown and described herein are exemplary. Some details are well known to those skilled in the art, and as such are neither shown nor described.

Figure 1A:
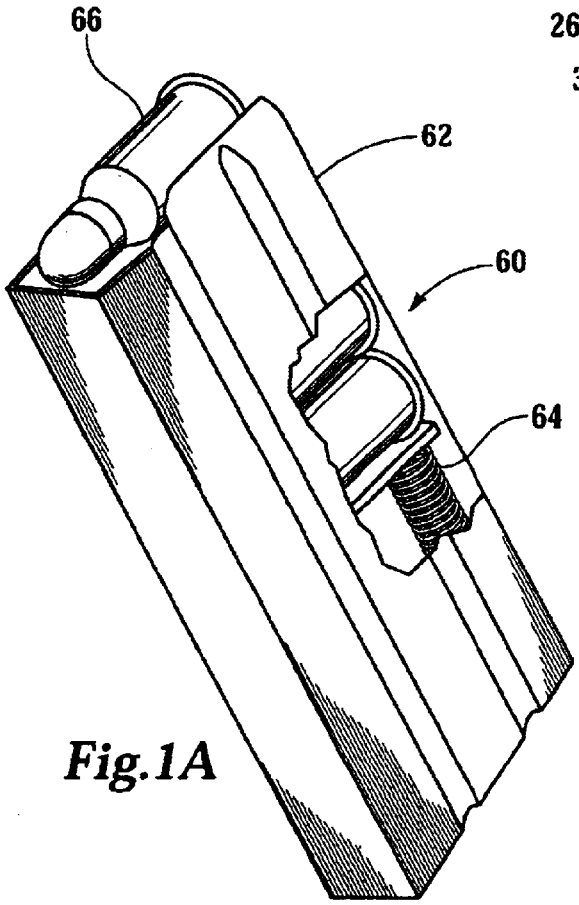
FIG. 1A is a view, similar to the view of FIG. 1, of a prior art, multiple round magazine.
Figure 3:
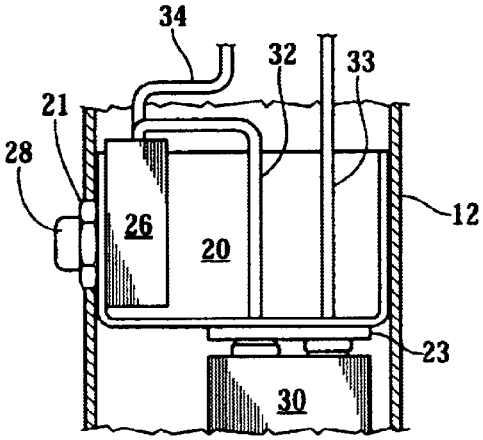
FIG. 3 shows a detail view of a circuit connector/disconnector and battery arrangement.
Figure 2:
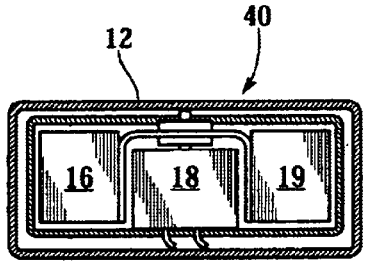
FIG. 2 is a cross-section view of the barrel cooling apparatus of FIG. 1, as seen along cutting plane 2—2.

FIG. 1 is a perspective view of a preferred embodiment of gun barrel cooler 10 of the present inventions, showing housing 12, with the working parts internally mounted in a manner best understood when considered in conjunction with following FIGS. 2 and 3. In order to appreciate the present inventions, it is necessary to understand the dimensional similarities of housing 12 to magazine housing 62 of the multiple round magazine 60 shown in prior art FIG. 1A. Magazine 60 is adapted by size and shape to fit a specific model firearm, as are embodiments of the present inventions. Magazine 60 is a companion part which is inserted into the receiver of a given firearm to feed successive rounds for firing. After a round is fired, the empty casing is extracted by rearward retraction of a sliding member and spring 64 positions the next round 66 for insertion into the firing chamber. Forward movement of the sliding member then chambers round 66 for firing. For firearms having a sliding member that does not lock in a retracted position on an empty chamber, bolt stop plate 22 may be mounted to housing 12 behind fan assembly 14, to hold the sliding member in a rearward position. Indicator flag 24 may also be provided, so that insertion of barrel cooler 10 will be obvious to range safety observers. Indicator flag 24 is flexible, and curved slightly to extend out of the ejector port of the receiver when the barrel cooler is inserted and should be colored orange, to make it as obvious as is possible.

FIG. 2 is a cross-section view taken through fan assembly 14, along cutting plane 2—2, at the center line of fan impeller 19 and fan motor 18. Cooling fan assembly 14 includes fan motor 18 and shroud 16. Shroud 16 has air inlet 40, hidden in FIG. 1, but clearly shown here, and air outlet 50. It is to be noted that air outlet 50 is located in much the same relative position to housing 12 as is next round 66 to magazine housing 62. When barrel cooler 10 is inserted into a firearm in the place and manner of magazine 60, with the sliding member in the retracted position, air outlet 50 is in alignment with the firing chamber. The rotation of impeller 19 is directed to draw air in through air inlet 40, for discharge from air outlet 50. Thus, a flow of cooling air is drawn from the open receiver and passed directly into and through the gun barrel. Fan assembly 14 is a close fit inside of housing 12, so that adhesive bonding is a preferred means of attachment therein. Here also is shown the manner of mounting impeller 19 for rotation with the output of fan motor 18.

FIG. 3 provides a clearer view of bracket 20, which provides a suitable structure for the mounting of normally open circuit connector/disconnector 26 and battery 30 within housing 12. Bracket 20 is made to fit closely to the internal dimensions of housing 12, where it may be affixed by welding, riveting or bonding. Circuit connector/disconnector 26 is mounted to bracket 20 by panel mounting nut 21, so that actuator 28 extends through housing 12, where it is actuated when barrel cooler 10 is inserted into the firearm receiver. Battery 30 snaps into terminal clip 23 so as to be readily replaceable, and terminal clip 23 is attached to bracket 20 by adhesive bonding. Clearly, the mounting arrangement of the battery 30 and terminal clip 23 is a matter of the designer's choice. As shown in FIG. 1, insulated wire 33 provides connection for the negative terminal of battery 30 to fan motor terminal 38. The positive terminal connection of battery 30 is by insulated wire 32, by way of normally open circuit connector/disconnector 26 and insulated wire 34 to second fan motor terminal 36. Thus, when circuit connector/disconnector actuator 28 is depressed, normally open circuit connector/disconnector 26 is closed and fan motor 18 is activated.

Figure 4:
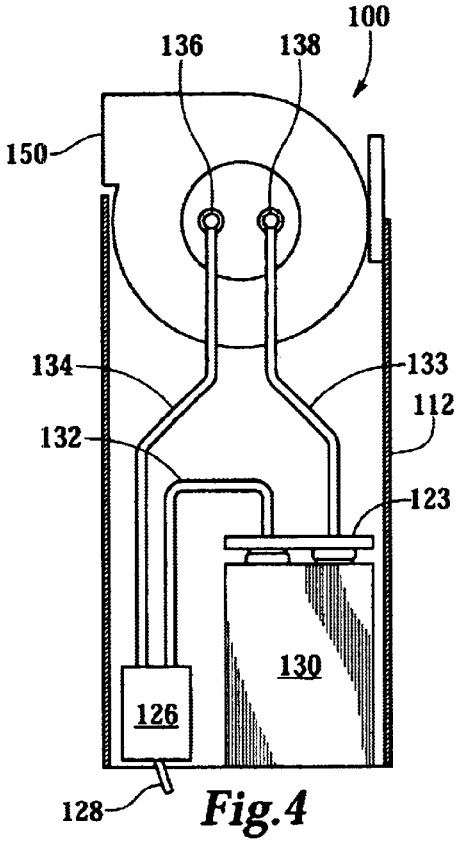
FIG. 4 shows an alternative, manually operated circuit connector/disconnector for a second preferred embodiment of the present inventions.

FIG. 4 shows a second preferred embodiment of the present inventions as barrel cooler 100 wherein housing 112 is equivalent to housing 12 of barrel cooler 10. Fan assembly 114 is connected by insulated wires 132, 133 and 134 to battery 130 by way of terminal clip 123. Barrel cooler 100 differs from barrel cooler 10 only in that circuit connector/disconnector 126 is manually operated by selectively positioning actuator 128 to electrically connect or disconnect wires 132 and 134 and provide air flow from outlet 150.

Figure 5:
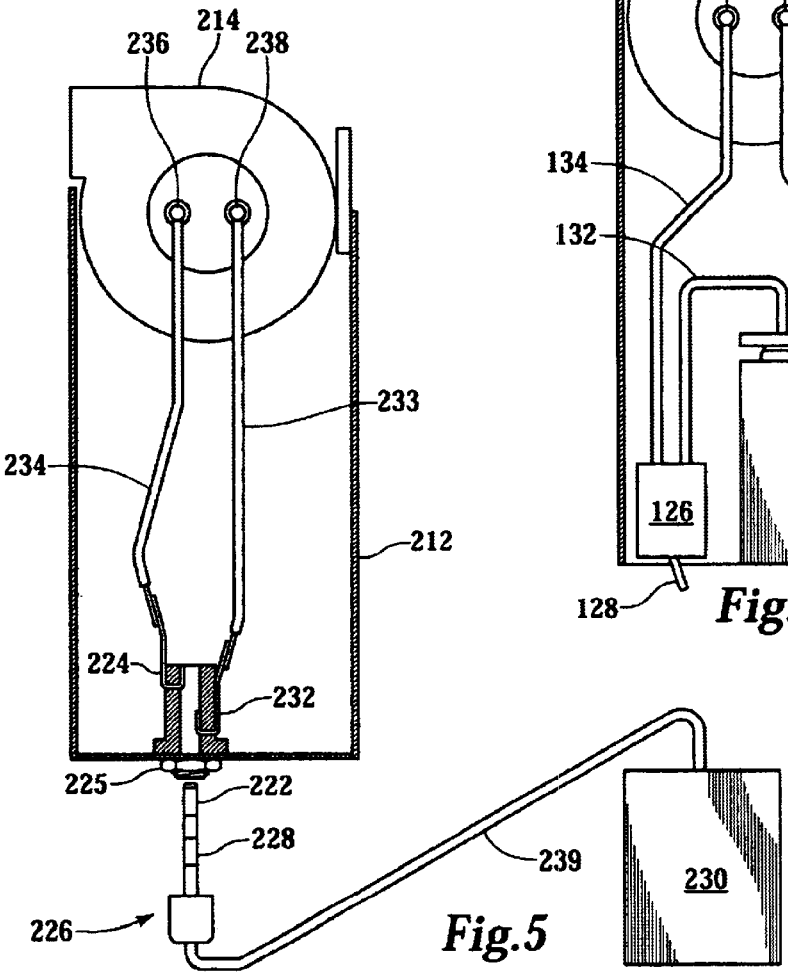
FIG. 5 shows a remote power supply and circuit connector/disconnector as used for another preferred embodiment of the present inventions.

FIG. 5 shows another preferred embodiment of the present inventions as barrel cooler 200 wherein housing 212 is equivalent to housing 12 of barrel cooler 10. Fan assembly 214 is connected by insulated wires 233 and 234 to battery pack 230 by way of circuit connector/disconnector 226, which is inserted into socket 225 where contacts 222 and 224 are connected, as are contacts 228 and 232. In this manner, fan motor terminals 236 and 238 are connected by two conductor cable 239 to the positive and negative terminals of battery pack 230.

The embodiments shown and described above are exemplary. It is not claimed that all of the details, parts, elements, or steps described and shown were invented herein. Even though many characteristics and advantages of the present inventions have been described in the drawings and accompanying text, the description is illustrative only. Changes may be made in the detail, especially in matters of shape, size, and arrangement of the parts within the scope and principles of the inventions. The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. Apparatus for cooling the barrel of a gun comprising:

a gun having a receiver configured to receive a magazine;

a fan including a fan motor and shroud with an air inlet and outlet;

a electric power source for operating the fan motor, so as to establish an air flow path through the air inlet and outlet;

a housing configured for insertion into the receiver in the place and manner of a magazine and containing the fan and fan motor so that the air flow path is directed to pass through the gun barrel; and a circuit connector/disconnector, with "ON" and "OFF" positions, connecting the power source to the fan motor, so as to enable selective operation of the fan.

2. Apparatus for cooling the barrel of a gun according to claim 1, wherein the power source is remote from the housing.

3. Apparatus for cooling the barrel of a gun according to claim 1, wherein the circuit connector/disconnector is remote from the housing.

4. Apparatus for cooling the barrel of a gun according to claim 1, wherein the power source is a battery.

5. Apparatus for cooling the barrel of a gun according to claim 1, wherein the power source and circuit connector/disconnector are remote from the housing.

6. Apparatus for cooling the barrel of a gun according to claim 1, wherein the circuit connector/disconnector is placed in the "ON" position by insertion of the housing into the receiver.

7. Apparatus for cooling the barrel of a gun according to claim 4, wherein the circuit connector/disconnector is placed in the "ON" position by insertion of the housing into the receiver.

8. Apparatus-for cooling the barrel of a gun comprising:

a gun having a receiver configured for insertion of a magazine housing;

a housing configured for insertion into the receiver in the place and manner of a magazine;

a fan mounted inside the housing and including a fan motor and shroud having an air inlet and outlet, wherein the outlet is positioned to cooperate with the barrel for passing air flow therethrough;

a battery, mounted inside of the housing, to operate the fan motor and provide air flow through the inlet and outlet, so that the air flow path is directed to pass through the gun barrel; and a circuit connector/disconnector, with "ON" and "OFF" positions, connecting the battery to the fan motor for selective operation of the fan, and mounted inside of the housing, so as to be set in the "ON" position when inserted in the receiver.

9. The method of cooling the barrel of a gun comprising the steps of:

providing a gun having a receiver configured for insertion of a multiple round magazine;

providing a fan housing externally similar to the magazine;

mounting a fan, with a fan motor, inside of the fan housing;

mounting a battery inside of the fan housing for selectively powering the fan;

inserting the fan housing into the receiver in the place and manner of the magazine;

connecting the battery to the fan motor for operation of the fan, so as to create air flow; and directing the air flow to pass along a path from the receiver into and through the gun barrel.

10. The method of claim 9 wherein the step of connecting the battery to the fan motor is inherently implemented by insertion of the fan housing into the receiver.

* * * * *